US005586528A

United States Patent [19]

Speil

[11] Patent Number: 5,586,528

[45] Date of Patent: Dec. 24, 1996

[54] TAPPET FOR THE VALVE DRIVE OF AN INTERNAL COMBUSTION ENGINE

[75] Inventor: Walter Speil, Ingolstadt, Germany

[73] Assignee: Ina Walzlager Schaeffler KG, Germany

[21] Appl. No.: 586,376

[22] Filed: Jan. 16, 1996

Related U.S. Application Data

[60] Continuation-in-part of Ser. No. 447,720, May 23, 1995, abandoned, which is a division of Ser. No. 340,024, Nov. 14, 1994, Pat. No. 5,450,826.

[30] Foreign Application Priority Data

Dec. 22, 1993 [DE] Germany ..... 43 43 876.8

[51] Int. Cl.[6] ..... F01L 1/25

[52] U.S. Cl. ..... 123/90.51; 123/90.55

[58] Field of Search ..... 123/90.48, 90.49, 123/90.51, 90.55; 74/569

[56] References Cited

U.S. PATENT DOCUMENTS 4,465,038 8/1984 Speil ..... 123/90.55
4,648,360 3/1987 Schaeffler ..... 123/90.55

*Primary Examiner*—Weilun Lo
*Attorney, Agent, or Firm*—Bierman and Muserlian

[57] ABSTRACT

A tappet (1) for a valve drive of an internal combustion engine, characterized in that an upper edge (22) of the cylindrical element (15) extends directly along the underside (8) of the housing bottom (7) except in a region of a trough-like formation (24) provided in the cylindrical element (15) in a region of the underside (8) of the housing bottom (7) for oil transfer from the canal (19) into the annular oil reservoir (18), the ratio of the width of the recess (24) at an upper edge thereof facing the bottom of the width of the canal (19) is ≧1.75.

1 Claim, 3 Drawing Sheets

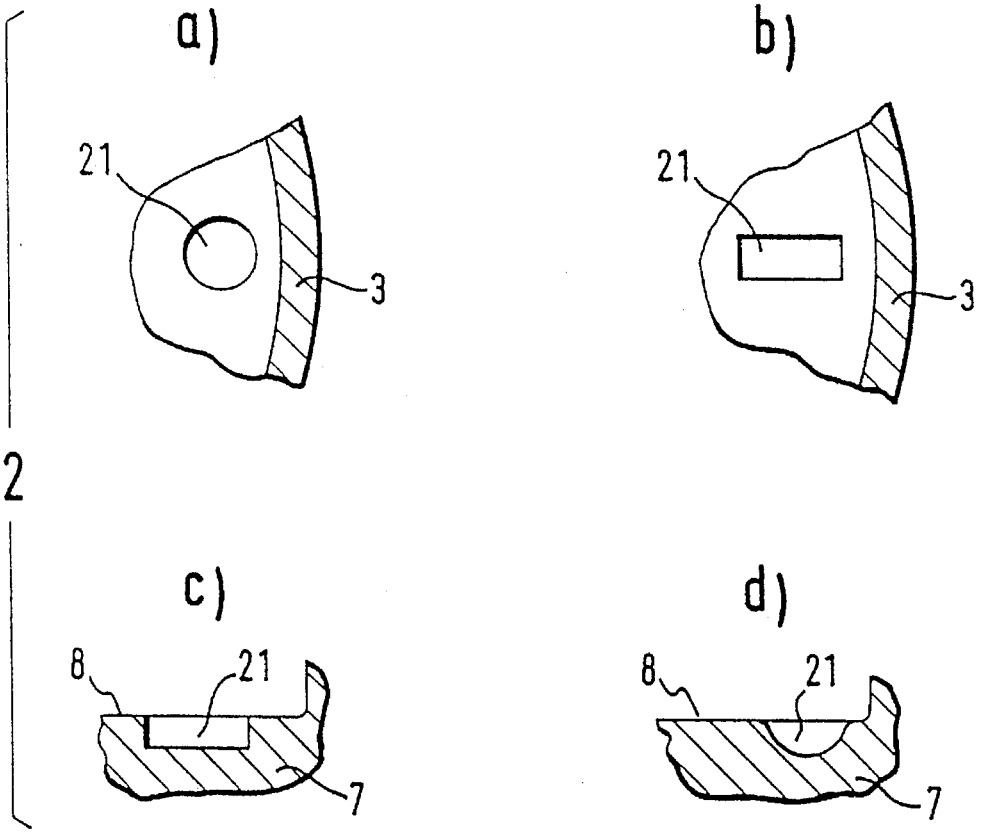
Fig. 2
Fig. 3
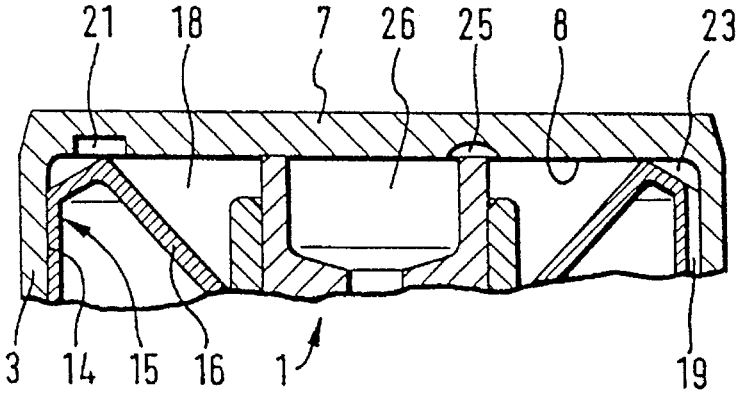

TAPPET FOR THE VALVE DRIVE OF AN INTERNAL COMBUSTION ENGINE

PRIOR APPLICATIONS

This application is a continuation-in-part application of U.S. patent application Ser. No. 447,720 filed May 23, 1995, now abandoned which is a division of U.S. patent application Ser. No. 340,024 filed Nov. 14, 1994, now U.S. Pat. No. 5,450,826.

STATE OF THE ART

A tappet for the valve drive of an internal combustion engine, comprising a hollow cylindrical housing which is arranged with its thin-walled jacket for axial displacement in a receiving bore of a cylinder head, said housing being closed at one front end by a thin-walled bottom, the tappet further comprising a hydraulic clearance compensation element which extends concentric with the jacket from an underside of the bottom and whose guide sleeve facing the underside of the bottom is surrounded by an axially displacement pressure piston whose bottom faces an end of a valve shaft, said tappet also comprising a thin-walled cylindrical element fixed in an oil-tight manner to an inner surface of the jacket, said element extending in the region of the jacket up to the bottom and forming an annular oil reservoir by merging into a radially inwards extending portion which continues into an axially oriented concentric guide portion for the pressure piston, a canal for hydraulic medium starting from a supply bore in the jacket and extending in the region of the jacket towards the bottom being formed in the cylindrical element, there being further provided in the bottom, a recess to allow oil transfer between the annular oil reservoir and a central oil reservoir is known from DE-PS 3,006,644. The hydraulic medium in this tappet is transferred into the annular space situated above the guide sleeve of the central clearance compensation element through the canal extending along an inner surface of a jacket of the tappet and opening into a radial portion under the bottom.

A disadvantage of this tappet known from DE-PS 3,006,6344 and considered as a species-defining tappet can consist in the fact that the point of discharge of its annular oil reservoir is situated at a lower level than the point of transfer of hydraulic medium into the central oil reservoir surrounded by the guide sleeve. By this, the height of the point of discharge of hydraulic medium into the annular oil reservoir is unnecessarily lessened and this necessitates a larger reserve of hydraulic medium to assure a reliable supply to the clearance compensation element. This amount of hydraulic medium has a disadvantageous weight-increasing effect on the total mass of the tappet, this disadvantage being substantially more striking in other tappets known to one skilled in the art because their annular oil reservoirs have a much larger volume. On the other hand, an appropriate thin-walled jacket forming the canal and delimiting the annular oil reservoir in a direction away from the cam is difficult to manufacture. In effect, if the canal is formed by stamping, the stress in this region on the edge of the cylindrical element facing the bottom is increased. A point of transfer between the canal and the annular reservoir in this edge region is hardly realizable or leads to crack formation.

OBJECTS OF THE INVENTION

It is an object of the invention to provide a tappet of the initially cited type in which the aforesaid disadvantages are eliminated and which is optimized with respect to its reliability and its operating weight, it being possible at the same time, to make the thin-walled element delimiting the annular oil reservoir by a reliable manufacturing method.

This and other objects and advantages of the invention will become obvious from the following detailed description.

THE INVENTION

The novel tappet (1) of the invention for a valve drive of an internal combustion engine, comprising a hollow cylindrical housing (2) arranged with a thin-walled jacket (3) for axial displacement in a receiving bore (4) of a cylinder head (5), said housing (2) being closed at one front end (6) by a thin-walled bottom (7), the tappet (1) further comprising a hydraulic clearance compensation element (9) which extends concentric with the jacket (3) from an underside (8) of the bottom (7) and whose guide sleeve (10) facing an underside (8) of the bottom (7) is surrounded by an axially displaceable pressure piston (11) whose bottom (12) faces an end of a valve shaft (13), said tappet (1) also comprising a thin-walled cylindrical element (15) fixed in an oil-tight manner to an inner surface (14) of the jacket (3), said cylindrical element (15) extending in a region of the jacket (3) up to the housing bottom (7) and forming an annular oil reservoir (18) by merging into a radially inwards extending portion (16) which continues into an axially oriented concentric guide portion (17) for the pressure piston (11), a canal (19) for hydraulic medium starting from a supply bore (20) in the jacket (3) and extending in a region of the jacket (3) toward the housing bottom (7) and being formed in the cylindrical element (15), there being further provided in the housing bottom (7), a recess (25) to allow oil transfer between the annular oil reservoir (18) and a central oil reservoir (26), characterized in that an upper edge (22) of the cylindrical element (15) extends directly along the underside (8) of the housing bottom (7) except in a region of a trough-like formation (24) provided in the cylindrical element (15) in a region of the underside (8) of the housing bottom (7) for oil transfer from the canal (19) into the annular oil reservoir (18), the ratio of the width of the recess (24) at an upper edge thereof facing the bottom of the width of the canal (19) is $\geqq 1.75$.

The invention achieves the object of the invention by the fact that at least one recess for a transfer of hydraulic medium from the canal to the annular oil reservoir is made in an underside of the bottom and overlaps an edge of the element in a radial direction. This recess assures that the point of discharge of the annular oil reservoir is situated at a relatively high level. It is possible at the same time to make the thin-walled element almost rotationally symmetrical so that manufacturing problems hitherto encountered in the prior art are eliminated or the disadvantageous bead formation no longer occurs. In the present case, the recess in the underside of the bottom is made by stamping, but shaping by machining is also conceivable.

A tappet with particularly reliable discharge features is obtained. From the manufacturing point of view, it is favorable to form the annular canal directly in the thin-walled element but it is also possible to make it by an appropriate shaping of the tappet. The invention also covers a solution in which the annular canal does not extend over the entire periphery of the bottom but only through a certain angle of the underside thereof.

The recess in the underside of the bottom preferably has a groove-shaped or circular geometry, it being also possible, if necessary, to arrange several such recesses spaced in the circumferential direction. If the bottom is constituted by a separate bottom plate, the recess can also be made as a through-opening in the bottom which would be more practical from the manufacturing point of view.

In another embodiment, the element which bears against the inner space of the jacket extends by its entire edge directly along the underside of the bottom, at least one trough-like formation being provided in the element in a region of the underside of the bottom for oil transfer from the canal into the annular oil reservoir. In this embodiment, the recess in the underside of the bottom is omitted. Rather, a "soft" transition is obtained between the canal of the thin-walled element extending towards the bottom and the annular oil reservoir, whereby the initially described disadvantageous crack formation is likewise avoided. The oil transfer passage thus formed has a substantially larger radius than the canal and may be arranged even at a point circumferentially adjacent to the longitudinal canal.

Manufacturing the thin-walled element out of a plastic material further contributes to a reduction of mass of the tappet as a whole. The thin-walled element may be fixed by locking onto the jacket of the tappet, but other fixing methods such as gluing, or in case the element is made of sheet metal, welding or soldering and other methods are also possible. Further, the oil supply bore leading to the axially extending canal may be arranged in an annular groove of the jacket of the tappet, in which case an extra safety device against rotation of the tappet can then be dispensed with.

The invention is not limited solely to the features of the claims. The combination of individual features of the claims with one another and with the disclosures contained in the discussion of advantages and the example of embodiments is conceivable and intended.

BRIEF DESCRIPTION OF THE DRAWINGS

FIG. 2*a*, 2*b*, 2*c*, an 2*d* are views showing different configurations of the recess, FIG. 3 is a partial view of a tappet of the invention having a recess arranged offset from the supply canal.

DESCRIPTION OF THE PREFERRED EMBODIMENTS

Figure 1:
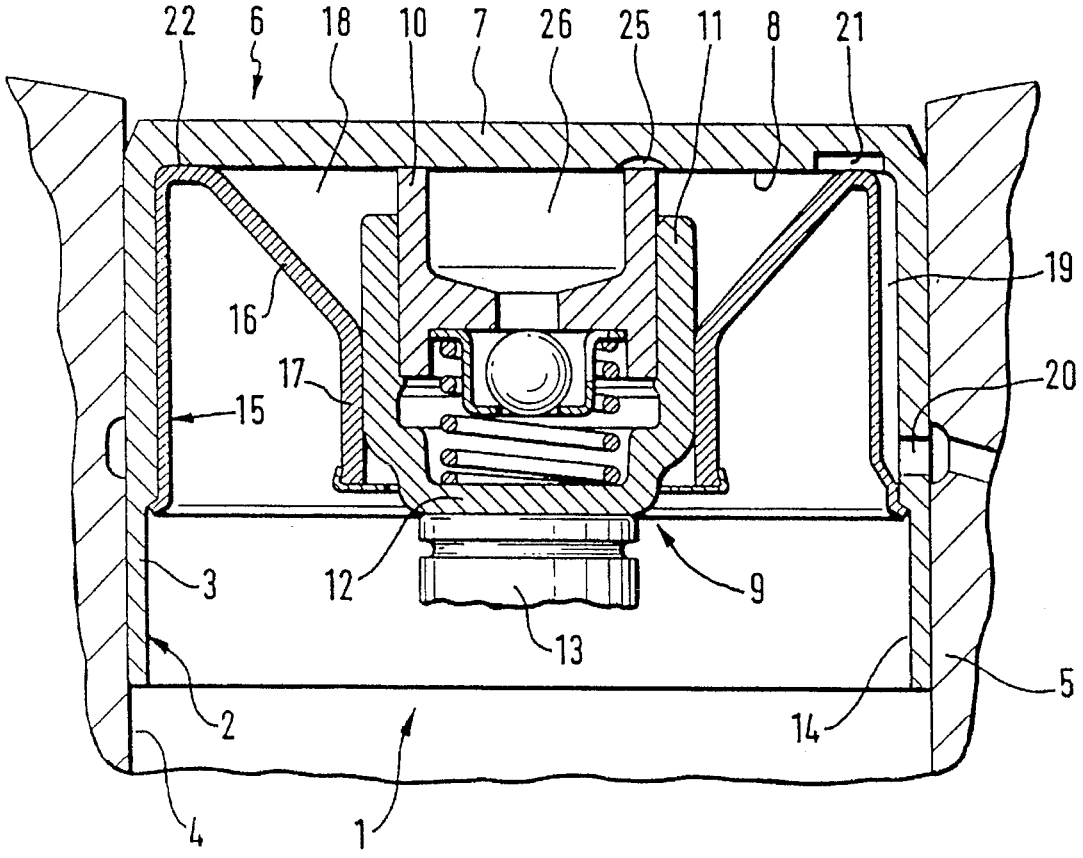
FIG. 1 is a longitudinal cross-section of a tappet of the invention.

FIG. 1 shows a tappet (1) comprising a hollow cylindrical housing (2) which is arranged with its thin-walled jacket (3) for axial displacement in a receiving bore (4) of a cylinder head (5). One front end (6) of the housing (2) is closed by a thin-walled bottom (7) and a hydraulic clearance compensation element (9) extends concentric with the jacket (3) from an underside (8) of the bottom (7). A guide sleeve (10) of the clearance compensation element (9) is surrounded by an axially displaceable pressure piston (11) and is supported on the underside (8) of the bottom (7). The bottom (12) of the pressure piston (11), in turn, is disposed on an end of a valve shaft (13).

On an inner surface (14) of the jacket (3), there is arranged in an oil-tight manner, an annular thin-walled element (15). A jacket portion of this element (15) extends directly up to the underside (8) of the bottom (7). The next portion is a funnel-shaped portion (16) which is oriented radially inwards and which, in a direction away from the cam, merges with a concentric guide portion (17) for the guidance of the pressure piston (11). The funnel-shaped portion (16) thus delimits, in a direction away from the cam, an annular oil reservoir (18) which surrounds the clearance compensation element (9) under the bottom (7). A canal (19) for hydraulic medium extending towards the bottom (7) is formed into the cylindrical element (15) in the region of the jacket (3). This canal (19) is supplied with hydraulic medium through a supply bore (20) made in the jacket (3) and a transfer passage for hydraulic medium from the canal (19) to the annular oil reservoir (18) is constituted by a recess (21) arranged in the underside (8) of the bottom (7). This recess (21) permits the thin-walled element (15) to be made so as to extend directly up to the bottom (7) along its entire periphery, whereby, as already described, manufacturing is simplified. At the same time, the point of oil transfer into the annular oil reservoir (18) is shifted to a relatively "high" level in the tappet (1), whereby the discharge reliability of the tappet is improved and the amount of hydraulic medium required as a reserve is simultaneously minimized.

FIGS. 2*a* to 29 show different view of proposed alternative configurations of the recess (21), FIGS. 2*a* to 2*b* being bottom views and FIGS. 2*c* and 2*d* being cross-sections.

FIG. 3 shows an embodiment in which the recess (21) is offset with respect to the canal (19). An annular canal (23) formed into the thin-walled element (15) extends in an edge region between the underside (8) of the bottom (7) and the inner surface (14) of the jacket (3) so that a particularly discharge-reliable tappet (1) is obtained, it being possible at the same time to connect the annular canal (23) to the oil reservoir (18) by several such circumferentially spaced recesses (21).

Figure 4:
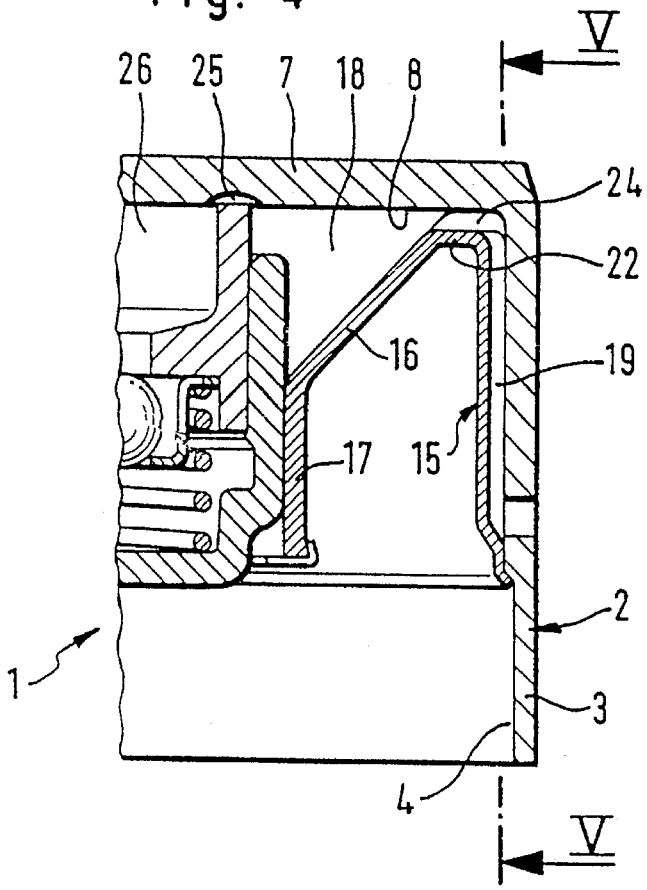
FIG. 4 is a partial cross-section of a further embodiment of the thin-walled element.
Figure 5:
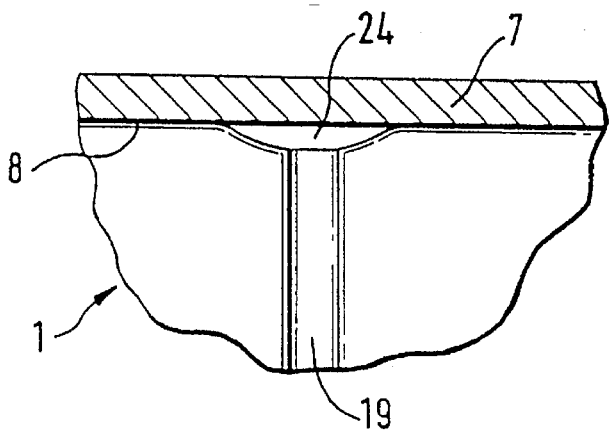
FIG. 5 is a cross-section taken along the line V—V of FIG. 4.

FIGS. 4 and 5 show an alternative to the embodiment of FIG. 1 for the transfer of hydraulic medium into the annular oil reservoir (18). The entire edge (22) of the thin-walled element (15) extends up to the underside (8) of the bottom (7), at least one trough-like formation (24) for transfer of hydraulic medium from the canal (19) into the annular oil reservoir (18) being provided in the region of the edge (22). The ratio of the width of the recess (24) at the upper edge thereof facing the bottom of the width of the canal (19) is $\geqq 1.75$ resulting in a particularly soft contour of recess (24) which prevents distortions and crack formation which occurs in the prior art recesses with vertical walls. Due to this trough-like formation (24), a "soft" material transfer is obtained in the otherwise difficult-to-deform edge region (22) so that the feared crack formation and similar defects known from the prior art do not occur in this region during the shaping operation. The annular oil reservoir (18) is connected via a recess (25) with a central oil reservoir (26) situated within the guide sleeve (10).

When mounting the element (15) of the embodiments of FIGS. 1 and 4 in the tappet (1), the canal (19) of the element (15) has to be made to register with the recess (21). However, similar to the embodiments of FIG. 3, configurations are also possible in which, due to the provision of circumferentially spaced or interconnected canals and transfer passages, such a registering is not required.

Various modifications of the tappet of the invention may be made without departing from the spirit or scope thereof and it is to be understood that the invention is intended to be limited only as defined in the appended claims.

What I claim is:

1. A tappet (1) for a valve drive of an internal combustion engine, comprising a hollow cylindrical housing (2) arranged with a thin-walled jacket (3) for axial displacement in a receiving bore (4) of a cylinder head (5), said housing (2) being closed at one front end (6) by a thin-walled bottom (7), the tappet (1) further comprising a hydraulic clearance compensation element (9) which extends concentric with the jacket (3) from an underside (8) of the bottom (7) and whose guide sleeve (10) facing an underside (8) of the bottom (7) is surrounded by an axially displaceable pressure piston (11) whose bottom (12) faces an end of a valve shaft (13), said tappet (1) also comprising a thin-walled cylindrical element (15) fixed in an oil-tight manner to an inner surface (14) of the jacket (3), said cylindrical element (15) extending in a region of the jacket (3) up to the housing bottom (7) and forming an annular oil reservoir (18) by merging into a radially inwards extending portion (16) which continues into an axially oriented concentric guide portion (17) for the pressure piston (11), a canal (19) for hydraulic medium starting from a supply bore (20) in the jacket (3) and extending in a region of the jacket (3) toward the housing bottom (7) and being formed in the cylindrical element (15), there being further provided in the housing bottom (7), a recess (25) to allow oil transfer between the annular oil reservoir (18) and a central oil reservoir (26), characterized in that an upper edge (22) of the cylindrical element (15) extends directly along the underside (8) of the housing bottom (7) except in a region of a trough-like formation (24) provided in the cylindrical element (15) in a region of the underside (8) of the housing bottom (7) for oil transfer from the canal (19) into the annular oil reservoir (18), the ratio of the width of the recess (24) at an upper edge thereof facing the bottom of the width of the canal (19) is $\geqq 1.75$.

* * * * *